United States Patent [19]

Marburger et al.

[11] 3,986,684

[45] Oct. 19, 1976

[54] FOLDING TAIL FINS

[75] Inventors: Ivan L. Marburger, Upland, Calif.; Donald E. Howlett, Reno, Nev.; Lawrence J. Nagel, La Verne, Calif.

[73] Assignee: The United States of America as represented by the Secretary of the Army, Washington, D.C.

[22] Filed: Dec. 4, 1975

[21] Appl. No.: 637,810

Related U.S. Application Data

[62] Division of Ser. No. 493,005, July 30, 1974, Pat. No. 3,946,969.

[52] U.S. Cl. ..... 244/3.28

[51] Int. Cl.[2] ..... F42B 13/32

[58] Field of Search..... 244/3.27, 3.28, 3.29

[56] References Cited

UNITED STATES PATENTS

| | | | |
|---|---|---|---|
| 2,801,587 | 8/1957 | Gould | 244/3.28 |
| 3,098,446 | 7/1963 | Jasse | 244/3.28 |

*Primary Examiner*—Verlin R. Pendegrass

*Attorney, Agent, or Firm*—Nathan Edelberg; Robert P. Gibson; Harold W. Hilton

[57] ABSTRACT

A rocket having flip out tail fins with cooperating surfaces on said fins and the rear of said rocket to maintain said fins in extended position. Spring means for urging said cooperating surfaces into engagement with each other.

1 Claim, 3 Drawing Figures

FOLDING TAIL FINS

This is a division of application Ser. No. 493,005, filed July 30, 1974 and now U.S. Pat. No. 3,946,969.

BACKGROUND OF THE INVENTION

In a tube lauched rocket the tail fin structure must be capable of being folded or retracted to within the missile profile while the missile is within the launch tube. The fins must then be capable of extension into the air stream after launch. Means must be provided to firmly maintain said fins in their extended position.

In accordance with the need it is an object of this invention to provide a flip out fin structure which can be maintained in its extended position.

DETAILED DESCRIPTION OF THE INVENTION

Figure 1:
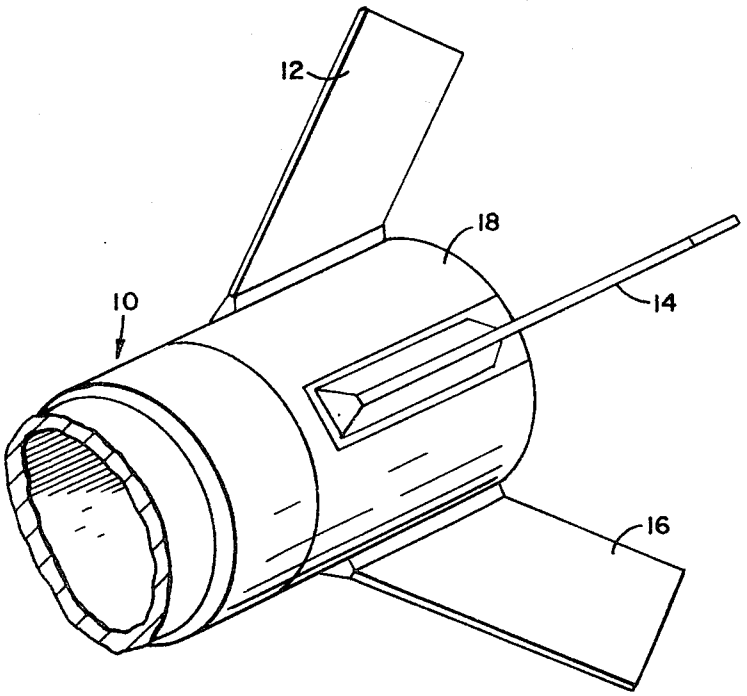
FIG. 1 is a perspective of the rear portion of a missile illustrating the fins of the present invention.

Referring now to the drawings and particularly to FIG. 1 the numeral 10 generally indicates the rear portion of a missile. Four fins, only three of which are shown at 12, 14, and 16, are attached to the rear end of the missile 10. Each of the fins is attached to the missile 10 in the same manner. A shroud 18 is attached to the missile 10 and the fins are adapted to project through slots in the shroud.

Figure 2:
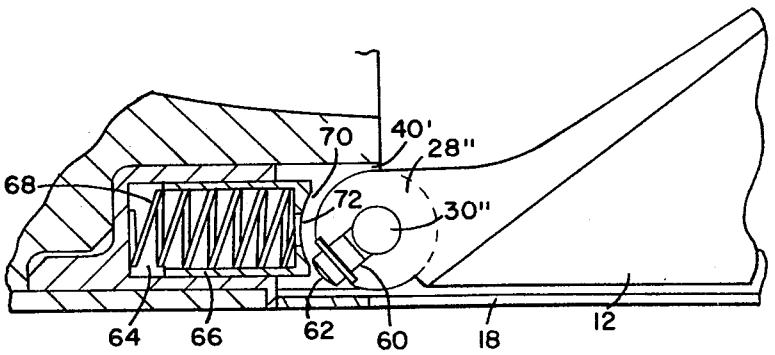
FIG. 2 illustrates the fin mounting structure of FIG. 1 with the fin in retracted position.
Figure 3:
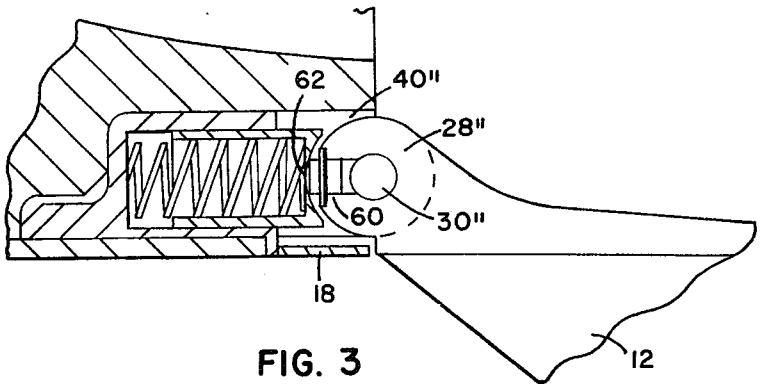
FIG. 3 is similar to FIG. 2 but shows the fin in extended position.

Referring now to FIGS. 2 and 3, the hub 28'' of the fin 12 is mounted between two lugs 40' on the missile 10 by a hinge pin 30''. The hub 28'' is provided with a radially extending pin 60 which projects slightly beyond the periphery of the hub 28''. As shown in the drawings the outer end of pin 60 is rounded.

A recess 64 is provided in the rear portion of the missile 10 and a plunger 66 is slideably mounted in the recess 64. A spring 68 normally urges the plunger 66 rearwardly toward the hub 28''. The rearmost end of plunger 68 is arcuate as shown at 70 and is provided with a central circular recess 72.

When the fin 12 moves from its retracted position shown in FIG. 2 to its extended position shown in FIG. 3, the pin 60 is aligned with the recess 72 in the plunger 66. The plunger 66 then moves rearwardly under the influence of spring 68 until the recess 72 embraces the pin 60 to lock the fin 12 in its extended position.

I claim:

1. A flip out tail assembly for a missile comprising:

pairs of lugs extending rearwardly from said missile;

four fins each having a hinged portion pivotally secured between said pair of lugs; a pin mounted radially in the hinge portion of each fin and projecting therefrom;

a plunger slidably mounted in the rear of said missile adjacent each said pair of lugs, said plunger provided with an arcuate surface having a central opening therein;

spring means for biasing said arcuate surface of said plunger against said pin, whereby said pin slides across said arcuate surface during extension of said fin and is retained in said central opening responsive to said fin reaching its fully extended position; and, a shroud assembly fixed to said missile and having four longitudinal slots formed therein through which the fins are adapted to project.

* * * * *